US007090049B2

(12) United States Patent
Adair

(10) Patent No.: US 7,090,049 B2
(45) Date of Patent: Aug. 15, 2006

(54) AQUATIC LADDER ADAPTED FOR MARINE APPLICATIONS

(76) Inventor: Michael Ray Adair, 130 Spring Ridge Ct., Roswell, GA (US) 30076

( * ) Notice: Subject to any disclaimer, the term of this patent is extended or adjusted under 35 U.S.C. 154(b) by 0 days.

(21) Appl. No.: 10/836,180

(22) Filed: Apr. 30, 2004

(65) Prior Publication Data

US 2005/0241563 A1 Nov. 3, 2005

(51) Int. Cl.
*E06C 9/06* (2006.01)
*B63B 27/14* (2006.01)

(52) U.S. Cl. ..... 182/97; 182/106; 114/362

(58) Field of Classification Search ..... 114/343, 114/362–364; D25/62–65; 182/21, 33, 93, 182/95–97, 106, 107, 112, 113, 127
See application file for complete search history.

(56) References Cited

U.S. PATENT DOCUMENTS 3,283,402 A * 11/1966 Larson ..... 29/512
3,446,309 A * 5/1969 Davis et al. ..... 182/129
3,973,646 A * 8/1976 Martinez ..... 182/97
D243,953 S * 4/1977 Gannon ..... D25/64
4,495,883 A * 1/1985 Hoy ..... 114/343
D411,019 S * 6/1999 Curtis ..... D25/62
2005/0077106 A1* 4/2005 Grundler ..... 182/97
2005/0274574 A1* 12/2005 Adair ..... 182/127

* cited by examiner

*Primary Examiner*—Ajay Vasudeva
(74) *Attorney, Agent, or Firm*—Sanford J. Asman

(57) ABSTRACT

The aquatic ladder was designed for ease of use, rather than ease of storage. It has wide, deep treads, arranged like a staircase, with side and upper railings which make it easy to enter or exit the water, even by elderly people, tired individuals, those carrying aquatic equipment, such as SCUBA gear or water skis, and, even, by pets. In the preferred embodiment, the aquatic ladder includes upper railings which each have an inverted "U" shape, and the distal end of those railings have hinged brackets for mounting the aquatic ladder to an object to be boarded. In an alternative embodiment, the aquatic ladder is mounted on a sliding rail, such that it can be raised, vertically, from the water, when it is not being used. The ladder is preferably made from aluminum, although it can be made of other materials, such as steel (e.g., stainless or galvanized), fiberglass, plastic, or other composites.

4 Claims, 2 Drawing Sheets

AQUATIC LADDER ADAPTED FOR MARINE APPLICATIONS

BACKGROUND OF THE INVENTION

The present invention relates to ladders used in marine applications. In particular, the invention relates to aquatic ladders used as boarding ladders on boats or to climb onto floating or fixed docks.

As used herein the term "aquatic ladder" is intended to mean those ladders which are specifically designed and intended for use while partially submerged. In the past, the primary objective addressed in the design of aquatic ladders has been ease of storage, rather than ease of use. Thus, many ladders designed for marine and aquatic applications (e.g., as boarding ladders on boats and ladders used to climb onto both fixed and floating docks) have been short (e.g., they had relatively few rungs extending into the water), or they have included features which allow them to be compact for storage and expanded for use (e.g., hinges for folding, sliding extensions, or sides made of chain or rope, so that they could be stored in a small volume). Most such aquatic ladders have also included rungs which are rather narrow, or round, making them even more uncomfortable and difficult to use. Due to their construction, the aquatic ladders of the prior art were also prone to considerable movement, as one tried to climb them, and they often lacked a secure handhold, particularly above the water level. While storage space is limited, and is, therefore, acknowledged to be a problem on boats, the consequence of making storage the primary objective in the design of an aquatic ladder is that the aquatic ladders heretofore known were difficult to use, and a challenge to ascend, particularly by pets (such as dogs), elderly persons, those carrying aquatic gear, such as SCUBA equipment or water skis, possibly some disabled persons, and even those in good physical shape who were simply tired from having engaged in aquatic activities without some assistance.

Further problems with the aquatic ladders previously known have involved the manner in which they attached to the boat or dock. In particular, since compact size has been the issue which was generally addressed, many ladders designed for aquatic use simply reached up to the lowest point possible, e.g., the surface of the dock or the gunwale (or swim platform) of the boat to be boarded. Further, they were typically placed immediately next to the object to which they were attached, meaning that they had very narrow steps, and that they were prone to swinging under such objects as they bore the weight of a person climbing them. Such designs have further increased the difficulty of their use.

While some of the aquatic ladders heretofore known have included design features which increase their usability, none have been found which truly address the issue of ease of use in a marine environment. By way of example, ladders heretofore known include those described in U.S. Pat. No. 6,378,654 entitled LADDER PIVOTALLY ATTACHED TO A GENERALLY VERTICALLY EXTENDING SURFACE which issued on Apr. 30, 2002 to Ziaylek, Jr., et al. which describes a ladder designed to be attached to a vehicle having a generally vertical wall. As shown in FIGS. 1–5, the ladder has a step supporting portion which slopes away from the vertical wall which supports substantially horizontal steps.

U.S. Pat. No. 5,896,946 entitled BOARDING LADDER AND WINCH MOUNT FOR BOAT TRAILERS AND THE LIKE which issued on Apr. 27, 1999 to W. E. Brackett describes a ladder having "steps" which enable easy access to a boat. However, while the ladder includes steps, and while it is adapted for use with a boat, it is intended to be integrated into a winch assembly on a boat trailer, and it is intended for use in accessing the boat while the boat is on a trailer, rather than for in-water use. Further, the disclosure of that patent distinguishes the ladder of the patent from a ladder which would provide in-water access in that it distinguishes the ladder of the patent from "boarding ladders" (See, Col. 1, lines 23–30) or aquatic ladders of the type described herein.

U.S. Pat. No. 5,339,919 entitled BOARDING LADDER ASSEMBLY HAVING A VARIABLE COUNTERWEIGHT LIFTING FORCE which issued on Aug. 23, 1994 to J. W. Boyd describes a boarding ladder assembly for mounting a boarding ladder in a manner which allows the boarding ladder to be lowered and raised. Again, the ladder is used on a vehicle, but it is not intended for a marine application in which the steps would be under water.

U.S. Pat. No. 4,724,925 entitled BOAT BOARDING LADDERS which issued on Feb. 16, 1988 to R. G. Ritten describes a boat boarding ladder having horizontal steps which are attached to a section which extends into the water at an angle from the vertical.

U.S. Pat. No. 4,719,989 entitled BOAT BOARDING LADDERS HAVING A STOWAGE FEATURE which issued on Jan. 19, 1988 to R. G. Ritten describes a boat boarding ladder having an upper inverted "U" shaped railing, but it does not have a vertical member, nor does it have hinges at the point of attachment.

U.S. Pat. No. 4,243,120 entitled RETRACTABLE BOARDING LADDER which issued on Jan. 6, 1981 to D. Pratt, Jr. describes a "boarding stairway" which has a stair supporting member which extends away from the vertical and which supports substantially horizontal steps. The entire assembly is adapted to be moved vertically, but it is not adapted for a marine application, nor does it include a vertical member which extends downward from the upper portion or an inverted "U" railing at its upper portion.

U.S. Pat. No. 4,186,820 entitled BOARDING LADDER AND STRAPS which issued on Feb. 5, 1980 to D. Cosman et al. describes a boarding ladder for use with an inflatable boat. The rungs are supported by a member which extends down and away from the boat. However, the ladder does not include the vertical member, the inverted "U" shaped rail, or the wide, horizontal steps of your invention.

SUMMARY OF THE INVENTION

Unlike the designs of the prior art, the present invention is an aquatic ladder whose design has ease of use as its primary objective. In order to accomplish that objective, the aquatic ladder of the present invention includes features which are intended to make it easy to use by persons, including elderly persons, those tired from having engaged in aquatic activities, some disabled persons, and those who might be carrying additional gear (e.g., SCUBA equipment or water skis). Further, the aquatic ladder of the present invention can be used by pets, and it provides both easy ingress into, and easy egress from, the water.

In order to accomplish these design objectives, the aquatic ladder of the present invention includes a pair of substantially parallel, substantially vertical members which extend downward into the water, and which preferably contact the hull or transom of the boat or side wall of the dock with which the aquatic ladder is being used. As used herein, the term "substantially vertical" is intended to mean that these members might not be vertical in a particular application, for example if the aquatic ladder is attached to the hull or transom of the boat which is not vertical, as it is preferred to have the substantially vertical support members lie proximate a wall of the item to be boarded (e.g., the boat or dock) in order to prevent relative movement between the aquatic ladder and the object to be boarded in order to increase the stability of the aquatic ladder. In accordance with the invention, the upper portions of the substantially vertical support members extend out of the water, and above the surface of the object to be boarded, and the upper portions include substantially inverted "U" shaped portions. These substantially inverted "U" shaped portions which extend up and over the surface of the dock, or the transom, swim platform, or gunwale of the boat, provide hand support rails which further ease use of the aquatic ladder of the present invention, particularly for those who are tired or who are unbalanced due to carrying such things as water skis or due to their having SCUBA gear on their back.

The aquatic ladder of the present invention further includes relatively deep, horizontal steps, rather than the thin, or round, rungs heretofore in general use. The rungs are preferably attached to sloped members which attach to the substantially vertical members adjacent the location where the substantially vertical members attach to the inverted "U" shaped rails.

While the main design objective of the ladder of the present invention has been to address ease of use, rather than ease of storage, it is recognized that the invention is intended for use in applications in which storage is of some concern. Accordingly, in the preferred embodiment, the aquatic ladder preferably includes a pair of hinges at the distal ends of the upper railings (i.e., the inverted "U" shaped portions), whereby the ladder can be swung up and out of the water.

Alternatively, in certain applications, the hinges may be eliminated, and the ladder can be mounted on sliding, substantially vertical rails which are affixed to the side of the object to be boarded.

DETAILED DESCRIPTION OF THE EXEMPLARY EMBODIMENTS

Figure 1:
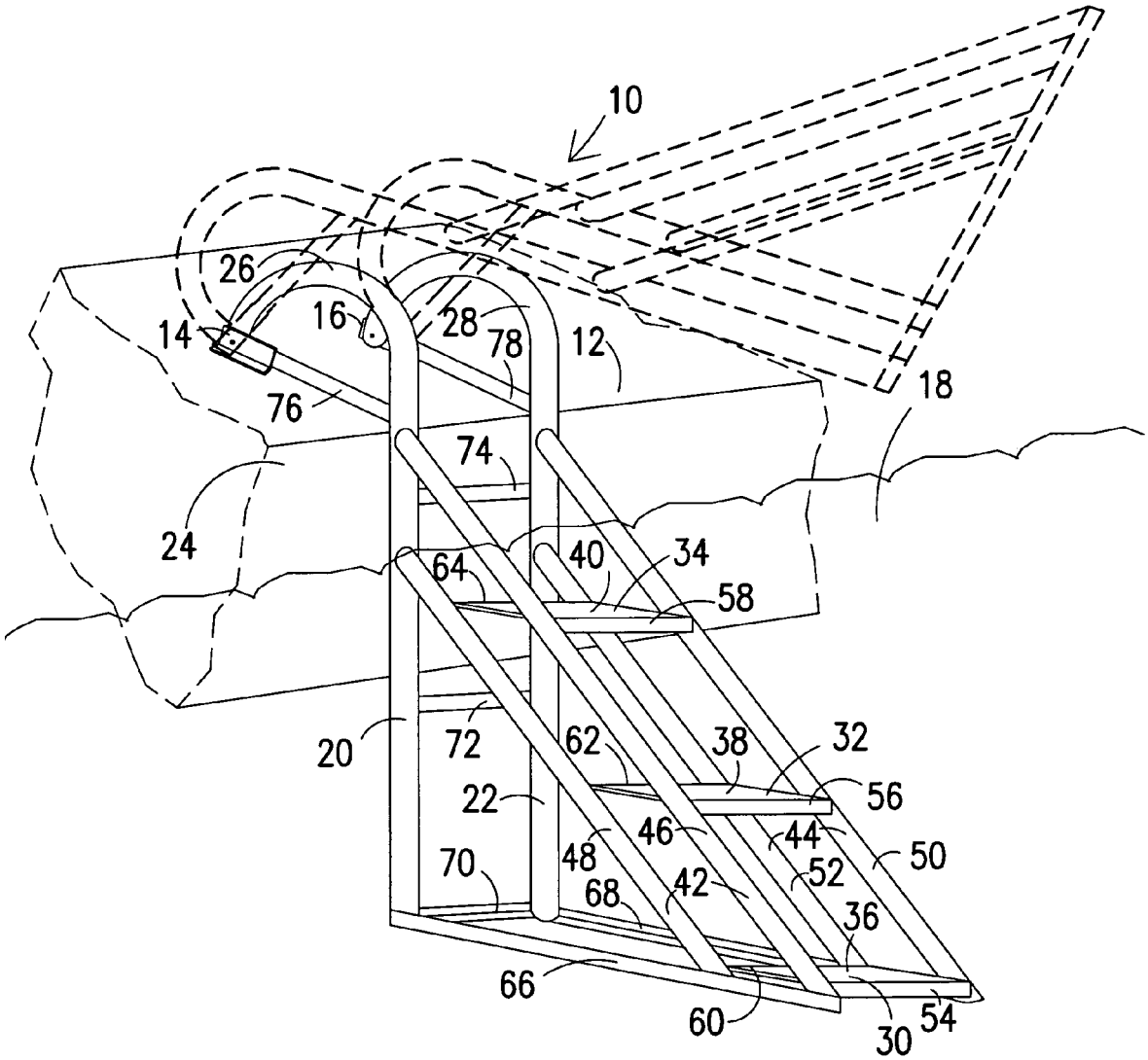
FIG. 1 is perspective view of the ladder of the preferred embodiment of the aquatic ladder of the present invention.

FIG. 1 is a perspective view of the preferred embodiment of the aquatic ladder 10 of the present invention, which is intended to be used in marine applications. The aquatic ladder 10 is shown attached to a dock 12, using a pair of hinged brackets 14, 16 which allow the aquatic ladder 10 to be swung up and out of the water 18, as shown in phantom. The aquatic ladder 10 is comprised of a pair of substantially parallel, substantially vertical support members 20, 22 which are spaced from one another, and which are designed to hang down adjacent the side 24 of the dock 12. The hinged brackets 14, 16 are attached to upper railings 26, 28, respectively, each of which is preferably in the shape of an inverted "U" so as to allow it to function as a hand railing.

The aquatic ladder 10 further comprises a series of steps 30, 32, 34 which are arranged in a staircase manner, with each of the steps 30, 32, 34 having relatively deep (i.e., front to rear) horizontal treads 36, 38, 40, which are about 8 to 10 inches deep in the preferred embodiment of the invention. The steps 30, 32, 34 are preferably fairly wide (e.g., about 16 inches wide in the preferred embodiment of the invention), and they preferably have about a 10 to 12 inch vertical rise between steps 30, 32, 34. As used in the preferred embodiment of the invention, the treads 36, 38, 40 can include a patterned or perforated surface, so as to make them less slippery. Diamond patterned aluminum is used in the aquatic ladder 10 of the preferred embodiment. The steps 30, 32, 34 each extend between a pair of spaced sloped step support members 42, 44, which are comprised, respectively, in the preferred embodiment of the invention, of pairs of front and rear supports 46, 48 and 50, 52, although those skilled in the art will recognize that it would be possible to have a single sloped step support member on either side of the steps 30, 32, 34, without departing from the invention. The deep treads 36, 38, 40 of the present invention provide flat steps for use by persons or pets using the aquatic ladder 10. With continued reference to FIG. 1, the steps 30, 32, 34 each have a front edge 54, 56, 58, and a rear edge 60, 62, 64, as shown. In the preferred embodiment shown, the portions of the steps 30, 32, 34 proximate their front edges 54, 56, 58 are affixed, by bolting or welding, to the front supports 46, 50, while the portions of the steps 30, 32, 34, proximate their rear edges 60, 62, 64, are affixed to the rear supports 48, 52, of the sloped step support members 42, 44.

Figure 2:
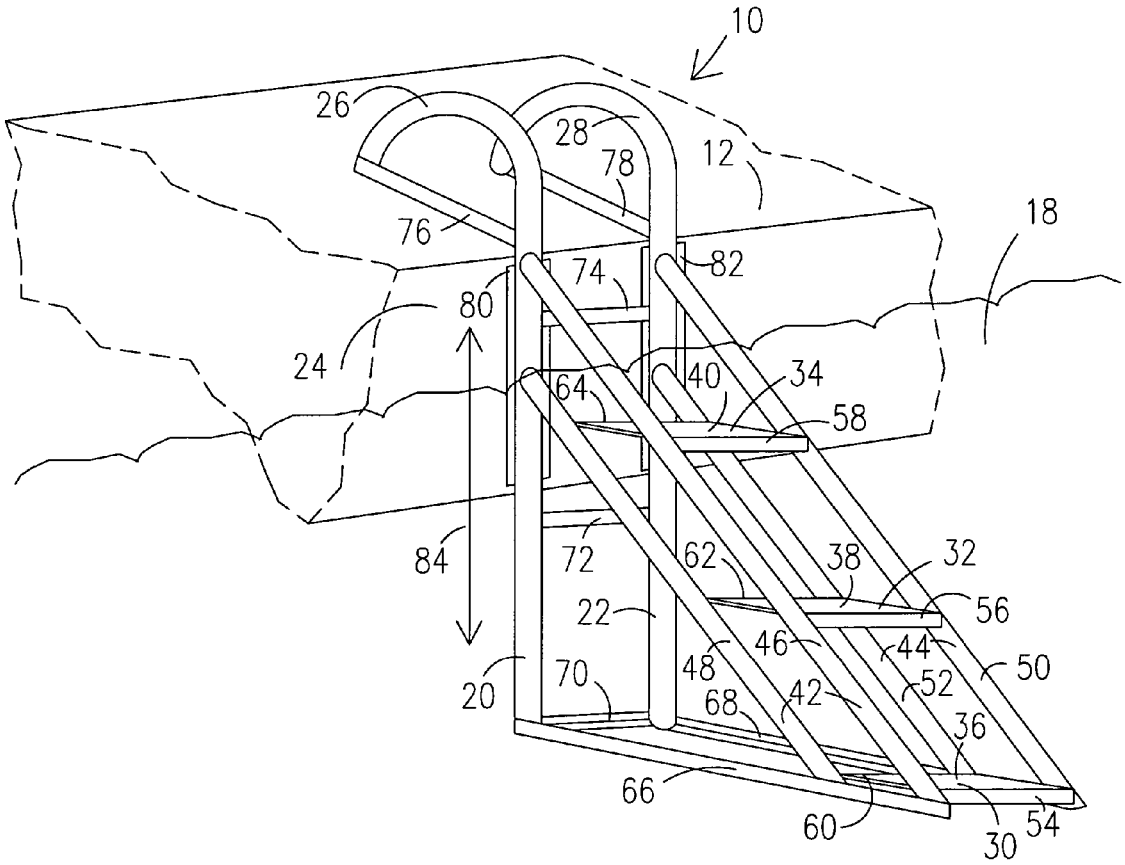
FIG. 2 is a perspective view of an alternative embodiment of the aquatic ladder of the present invention.

In the preferred embodiment of the invention, the aquatic ladder 10 further includes a pair of lower horizontal supports 66, 68, which connect the sloped step support members 42, 44 to the substantially vertical support members 20, 22 respectively. Preferably, the lower horizontal supports 66, 68 connect lower portions of the vertical spaced support members 20, 22 to respective lower ends of the sloped step support members 42, 44, as shown in FIG. 1 and FIG. 2. Additional horizontal supports 70, 72, 74 extend between the substantially vertical support members 20, 22 and a pair of upper horizontal supports 76, 78 extend between the upper portions of the substantially vertical support members and the distal ends of the upper railings 26, 28.

The described features of the aquatic ladder 10 make entry into, or exit from, the water 18 easy for both people and pets. The deep, flat, horizontal treads 36, 38, 40, mounted on the sloped step support members 42, 44 make it easy to "walk" up the ladder 10, while holding onto the front supports 46, 50, until near the top, where the upper railings 26, 28 provide further hand grips while exiting the water 18, thereby making the aquatic ladder 10 much like a stable staircase, rather than the challenge of the aquatic ladders heretofore known.

Pets, such as dogs, can easily get out of the water without having a person struggle with them while bent over a slippery swim platform or dock, even if they go into the water when no one is nearby to assist them.

Similarly, elderly people, and some disabled people who do not have the ability to climb the aquatic ladders of the prior art can use the aquatic ladder 10 of the present invention, as well. Whereas a person's natural buoyancy made using the swaying, unsecured aquatic ladders of the prior art a challenge, the buoyancy of their body actually assists the user of the aquatic ladder 10 of the present invention. In fact, due to the body's natural buoyancy, the aquatic ladder 10 of the present invention is even easier for someone to use than steps, and far less dangerous for elderly people than the aquatic ladders previously known. As compared to the swinging aquatic ladders heretofore known, which have a tendency to move under the dock or boat to which they are affixed, thereby causing the person to struggle with climbing while somewhat inverted, there is no comparison.

While the aquatic ladder 10 can be made of a variety of materials, bearing in mind that the ladder will be subject to a wet, and possibly salty environment, in the preferred embodiment the material used is solid, one piece aluminum. The steps 30, 32, 34 in the ladder 10 of the preferred embodiment, are made of diamond plate aluminum and are rolled at their front edges 54, 56, 58 to prevent cuts. The hinged mounting brackets 14, 16 allow the aquatic ladder 10 to be lifted out of the water 18 for storage.

This aquatic ladder 10 can be manufactured in a number of ways, allowing flexibility in meeting consumer requirements and shipping considerations. More specifically, the aquatic ladder 10 can be welded as a single solid piece, or it can be broken down into component pieces requiring assembly, or as an assembly kit to attach to an existing ladder. As will be recognized by those skilled in the art, construction materials may include, but are not limited to aluminum, steel (including galvanized steel and stainless steel), fiberglass, plastics, or other composites.

While it is preferred to include the hinged brackets 14, 16, as shown in FIG. 1, the aquatic ladder 10 can be solid mounted by bolting the upper plate directly to the mounting surface. Alternatively, the aquatic ladder 10 can also be mounted on a (substantially) vertical surface, such as the dock wall 24, as shown in FIG. 2, using attachment means which allow the ladder 10 to be slideably raised. In the alternative embodiment of the aquatic ladder 10, shown in FIG. 2, the sliding means are shown as a pair of channel rails 80, 82 which allow the ladder 10 to be lowered into the water 18 and raised back out and locked in the out position when not in use, as indicated by the double headed arrow 84.

As will be understood by those skilled in the art, while the aquatic ladder 10 of the present invention has been described as having three steps, the actual number of such steps may be varied, and may be greater, or fewer, than three without departing from the invention as described herein.

I claim:

1. An aquatic ladder, comprising:

(a) a pair of substantially parallel, substantially vertical spaced support members, each of said pair of substantially parallel, substantially vertical spaced support members extending upward to a hand rail which is formed as an inverted "U" shape, a pair of hinged brackets attached to the distal end of each said hand rail;

(b) a pair of spaced sloped step support members, the upper ends of said spaced sloped step support members being affixed, respectively, to the upper ends of said vertical spaced support members, the lower ends of said sloped step support members being spaced away from the lower ends of said pair of substantially vertical spaced support members, said spaced sloped step support members being spaced from one another;

(c) at least one relatively deep, and relatively wide substantially horizontal step being mounted between said pair of sloped step support members, whereby each said horizontal step is displaced both vertically and horizontally further from the point where said substantially vertical spaced support members meet said sloped step support members than any said horizontal step above it; and (d) a pair of substantially parallel, substantially horizontal spaced supports each connecting a respective lower portion of each of said pair of vertical spaced support members to respective ones of said lower ends of said sloped step support members, wherein said pair of spaced sloped step support members each comprise a front member and a rear member, said front members being attached to the front of said at least one horizontal step and said rear member being attached to the rear of said at least one horizontal step whereby said ladder can be hingedly attached to an object, whereby it can be swung upward and out of the water.

2. The aquatic ladder of claim 1 wherein said front members have a shape and configuration which allows them to function as handrails.

3. The aquatic ladder of claim 2 wherein said front members are formed of tubular material.

4. The aquatic ladder of claim 3 wherein said front members are formed of aluminum.

* * * * *